United States Patent [19]

Plapper et al.

[11] 4,264,318

[45] Apr. 28, 1981

[54] WATER-INSOLUBLE ALUMINOSILICATES AS TANNING AGENTS FOR THE DRESSING OF FUR SKIN

[75] Inventors: Juergen Plapper, Hilden; Klaus Schumann, Erkrath; Emanuel Arndt, Dusseldorf; Emil Ruscheinsky, Leverkusen, all of Fed. Rep. of Germany

[73] Assignee: Henkel Kommanditgesellschaft auf Aktien, Düsseldorf-Holthausen, Fed. Rep. of Germany

[21] Appl. No.: 56,350

[22] Filed: Jul. 10, 1979

[30] Foreign Application Priority Data

Jul. 21, 1978 [DE] Fed. Rep. of Germany ..... 2832089

[51] Int. Cl.[3] ..... C14C 3/04; C14C 3/06; C14C 3/08; C14C 3/22

[52] U.S. Cl. ..... 8/94.25; 8/94.26; 8/94.27; 8/94.29

[58] Field of Search ..... 8/94.26, 94.27, 94.29, 8/94.25

[56] References Cited

U.S. PATENT DOCUMENTS

| | | | |
|---|---|---|---|
| 2,395,472 | 2/1946 | Fernald et al. | 8/94.19 |
| 4,049,379 | 9/1977 | Erdmann et al. | 8/94.26 |

OTHER PUBLICATIONS

Derwent Abs. 1896B/02 12-12-78 Henkel (BE-86-8-481) "Use of Alkali Metal Aluminosilicates for Cleaning Crude Skins".

Derwent Abs. 10088/B06 Feb. 1, 1979 Henkel (DT 2732-215) "Additives for Defatting & Tanning in Leather Manuf.".

Chem. Abs. 20430t vol. 69 (1968) "Increasing the Water Resistance of Hides".

*Primary Examiner*—Joseph L. Schofer
*Assistant Examiner*—Herbert J. Lilling
*Attorney, Agent, or Firm*—Hammond & Littell, Weissenberger and Muserlian

[57] ABSTRACT

In the process of tanning for the production of dressed fur skins comprising subjecting pickled fur skins to the action of an aqueous liquor containing tanning agents, the improvement which comprises adding to the pickling bath as sole tanning agent a water-insoluble aluminosilicate, containing bound water, of the formula $$(Cat_{2/n}O)_x \cdot Al_2O_3 \cdot (SiO_2)_y$$

wherein Cat represents a cation selected from the group consisting of alkali metals, bivalent metal ions, trivalent metal ions and mixtures thereof; n represents an integer from 1 to 3; or x is a number of from 0.5 to 1.8; and y is a number of from 0.8 to 50, said aluminosilicates having an average particle size in the range of from 0.1$\mu$ to 5 mm and a calcium binding power of from 0 to 200 mg CaO/gm of anhydrous active substance measured at 22° C. according to the Calcium Binding Power Test Method.

23 Claims, No Drawings

WATER-INSOLUBLE ALUMINOSILICATES AS TANNING AGENTS FOR THE DRESSING OF FUR SKIN

BACKGROUND OF THE INVENTION

One of the most timely problems with the dressing of fur skins is the partial or complete replacement to be found for auxiliary agents, which put a high load on industrial sewage waters. With regard to dressing fur skins, in particular, basic aluminum tanning agents, in combination with other tanning and dressing agents, if desired, are normally used. However, resulting properties of the dressed fur skins, such as water resistance and shrinkage temperature, are frequently not satisfactory.

OBJECTS OF THE INVENTION

It is an object of this invention to provide an improved process of tanning for the production of dressed fur skins.

It is also an object of this invention to provide a process of tanning for the production of dressed fur skins whereby water-insoluble aluminosilicates are employed as tanning agent.

A further object of this invention is the reduction of the use of chemicals and of the burden on waste water systems during tanning to produce dressed fur skins.

These and other objects of the invention will become more apparent in the discussion below.

DETAILED DESCRIPTION OF THE INVENTION

This invention is directed to the reduction of the application of chemicals for tanning of dressed fur skins and the reduction of the concomitant burden on sewage waters. For this purpose, according to the invention, specified aluminosilicates are used as tanning agents for the dressing of fur skins, which aluminosilicates are ecologically acceptable, resulting in a considerable improvement of the sewage water situation. More specifically, this invention is directed to an improved tanning process for the production of dressed fur skins whereby the tanning agent comprises a water-insoluble aluminosilicate, containing bound water, of the formula $$(Cat_{2/n}O)_x.Al_2O_3.(SiO_2)_y$$

wherein Cat represents a cation selected from the group consisting of alkali metals, bivalent metal ions, trivalent metal ions and mixtures thereof; n represents an integer from 1 to 3, the valence of the cation; x is a number of from 0.5 to 1.8; and y is a number of from 0.8 to 50, said aluminosilicates having an average particle size in the range of 0.1$\mu$ to 5 mm and a calcium binding power of from 0 to 200 mg CaO/gm of anhydrous active substance measured at 22° C. according to the Calcium Binding Power Test Method set forth below in the Examples. Preferably y is a number of from 1.3 to 20.

It has been found that single-bath tanning can be performed with the aluminosilicates described herein, producing a degree of tanning that is adequate for fur skins. This is definitely higher than the degree of tanning that can be obtained with basic aluminum tanning agents. The result is a thin, resilient, light, fur skin leather, the desired product of the dressing of fur skins. The shrinkage temperature is 10° to 12° C. higher, on the average, than that resulting from comparable tanning processes with aluminum tanning agents. For this reason the fur skins tanned according to the invention are more resistant to toners and bleaching agents and can be dyed more easily.

In the practice of the invention, the dressing of the fur skins is carried out in conventional fashion. For example, the tanning is preceded in a well-known manner by soaking, washing and pickling. Soaking is carried out after thorough rinsing with the addition of anionic surface-active compounds or tensides. Mixtures of various anionic and nonionic surface active compounds or tensides in combination with degreasing agents and bleaching agents, if desired, are used for the wash. Pickling is performed in a table salt, i.e., sodium chloride, solution, with the addition of carboxylic acids, for example, formic acid or dicarboxylic acids such as adipic acid, or mixtures thereof, at a pH between about 2.5 and 3.5. Tanning is performed advantageously in the pickling bath, with the use of the described aluminosilicates. The initial amount of aluminosilicate should be from about 1 to 50, preferably about 4 to 6, gm/l. An electrolyte-resistant mixture of doubbin agents is also used to advantage.

The aluminosilicates to be used according to the invention are amorphous, crystalline, synthetic and natural products which are ecologically acceptable, i.e., completely safe. Of particular importance are those products where Cat in the above-mentioned formula denotes an alkali metal ion, preferably a sodium ion, x is a number of from 0.7 to 1.5, y is a number of from 0.8 to 6, preferably from 1.3 to b 4, whose average particle size is from 0.1 to 25$\mu$, preferably from 1 to 12$\mu$, and which have a calcium binding power according to the Calcium Binding Power Test Method of from 20 to 200 mg CaO/gm of anhydrous active substance. Of equal importance are products, which are identical with the above-mentioned products as far as the meaning of Cat, x, y and the calcium binding power is concerned, and which merely differ by having a larger average particle siize of from more than 25$\mu$ to 5 mm.

Such alkali metal aluminosilicates can be produced synthetically in a simple manner, for example, by reaction of water-soluble silicates with water-soluble aluminates in the presence of water. For this purpose, aqueous solutions of the starting materials can be mixed with one another, or a component present in a solid state may be reacted with the other component present in the form of an aqueous solution.

The desired alkali metal aluminosilicates are also obtained by mixing the two components, present in a solid state, in the presence of water. Alkali metal aluminosilicates can also be produced from $Al(OH)_3$, $Al_2O_3$ or $SiO_2$ by reaction with alkali metal silicate solutions or aluminate solutions, respectively. Finally, substances of this type are also formed from the melt, although, owing to high melting temperatures required and the necessity of converting the melt into finely distributed products, this method appears to be less interesting from an economic viewpoint.

Many of these alkali metal aluminosilicates and their preparation are described in U.S. Pat. No. 4,071,377, as well as in U.S. patent application Ser. No. 458,306, filed Apr. 5, 1974, now abandoned in favor of its continuation Ser. No. 800,308, filed May 25, 1977, now abandoned in favor of its continuation-in-part Ser. No. 956,851 filed Nov. 2, 1978. The alkali metal aluminosilicates produced by precipitation, or converted to an aqueous suspension in a finely distributed state by other methods, may be converted from the amorphous state into the aged or crystalline state by heating to temperatures of from 50° to 200° C. The amorphous or crystalline alkali metal aluminosilicate, present in an aqueous suspension, can be separated from the remaining aqueous solution by filtration and can be dried at temperatures of, for example, 50° to 800° C. The product contains a greater or smaller quantity of bound water according to the drying conditions. Anhydrous products are obtained by drying for 1 hour at 800° C. However, the hydrous products products are preferred, particularly those obtained by drying at from 50° to 400° C., particularly at from 50° to 200° C. Suitable products can have, for example, water contents of from about 2 to 30%, usually from about 8 to 27%, relative to their total weight.

The precipitation conditions can contribute to the formation of the desired small particle sizes of from 1 to 12μ, with the intermixed aluminate and silicate solutions-which may also be introduced simultaneously into the reaction vessel-being subjected to high shearing forces by, for example, intense agitation of the suspension. When crystalline alkali metal aluminosilicates are produced (these are preferably used in accordance with the invention), the formation of large, possibly interpenetrating crystals, is prevented by slow agitation of the crystallizing compound.

Nevertheless, undesired agglomeration of crystal particles may occur, particularly during drying, so that it may be advisable to remove these secondary particles in a suitable manner by, for example, air separation. Alkali metal aluminosilicates obtained in a coarser state and which have been ground to the desired grain size, can be used. By way of example, mills and/or air separators, or combinations thereof, are suitable for this purpose.

Preferred products are, for example, synthetically produced crystalline alkali metal aluminosilicates of the composition $$0.7\text{-}1.1M_2O.Al_2O_3.1.3\text{-}3.3SiO_2,$$

in which M represents an alkali metal cation, preferably a sodium cation. It is advantageous if the alkali metal aluminosilicate crystallites have rounded corners and edges.

If it is desired to produce the alkali metal aluminosilicates with round corners and edges, it is advantageous to start with a preparation whose molar composition lies preferably in the range $$2.5\text{-}6.0M_2O.Al_2O_3.0.5\text{-}5.0SiO_2.60\text{-}200H_2O$$

wherein M has the meaning given above and, in particular, represents the sodium ion. This preparation is crystallized in a conventional manner. Advantageously, this is effected by heating the preparation for at least ½ hour at from 70° to 120° C., preferably at from 80° to 95° C., under agitation. The crystalline product is isolated in a simple manner by separating the liquid phase. If required, it is advisable to re-wash the products with water and to dry them before further processing. Even when working with a preparation whose composition differs only slightly from that stated above, products having rounded corners and edges are still obtained, particularly when the difference only relates to one of the four concentration parameters given above.

Furthermore, fine-particulate water-insoluble alkali metal aluminosilicates may also be used in the method of the invention which have been precipitated and aged or crystallized in the presence of water-soluble inorganic or organic dispersing agents. Products of this type are described in U.S. patent applications Ser. No. 503,467, filed Sept. 5, 1974, now abandoned; Ser. No. 763,667, filed Jan. 28, 1977, now abandoned; and Ser. No. 811,964, filed June 30, 1977 now U.S. Pat. No. 4,126,574. They are obtainable in a technically simple manner. Suitable water-soluble organic, dispersing agents are tensides, i.e., surface-active compounds, non-surface-active-like aromatic sulfonic acids and compounds having a complex-forming capacity for calcium. The said dispersing agents may be introduced into the reaction mixture in an optional manner before or during precipitation, and, for example, they may be introduced in the form of a solution or they may be dissolved in the aluminate solution and/or silicate solution. Particularly satisfactory effects are obtained when the dispersing agent is dissolved in the silicate solution. The quantity of dispersing agent should be at least 0.05 percent by weight, preferably 0.1 to 5 percent by weight, based on the total amount of precipitate obtained. The product of precipitation is heated to temperatures of from 50° to 200° C. for from ½ to 24 hours for the purpose of aging or crystallization. By way of example, sodium lauryl ether sulfate, sodium polyacrylate, hydroxyethane diphosphonate and others, may be mentioned from the large number of dispersing agents which may be used.

Compounds of the general formula $$0.7\text{-}1.1Na_2O.Al_2O_3.>2.4\text{-}3.3SiO_2$$

consitute a special variant, with respect to their crystal structure, of the alkali metal aluminosilicates to be used in accordance with the invention.

Compounds of the formula $$0.7\text{-}1.1Na_2O.Al_2O_3>3.3\text{-}5.3SiO_2$$

constitute a further variant of the water-insoluble aluminosilicates to be used in accordance with the invention. The production of such products is based on a preparation whose molar composition lies preferably in the range $$2.5\text{-}4.5Na_2O.Al_2O_3.3.5\text{-}6.5SiO_2.50\text{-}110H_2O$$

This preparation is crystallized in a conventional manner. Advantageously, this is effected by heating the preparation for at least ½ hour to from 100° to 200° C., preferably to from 130° to 160° C., under vigorous agitation. The crystalline product is isolated in a simple manner by separation of the liquid phase. If required, it is advisable to wash the products with water and to dry them at temperatures of from 20° to 200° C., before further processing. The dried products thus obtained still contain bound water. When the products are produced in the manner described, very fine crystallites which come together to form spherical particles, possibly to form hollow balls having a diameter of approximately 1 to 4μ, are obtained.

Furthermore, alkali metal aluminosilicates suitable for use in accordance with the invention are those which can be produced from calcinated (destructured) kaolin by hydrothermal treatment with aqueous alkali metal hydroxide. The formula $$0.7\text{-}1.1M_2O.Al_2O_3.1.3\text{-}2.4SiO_2.0.5\text{-}5.0H_2O$$

corresponds to the products, M signifying an alkali metal cation, particularly a sodium cation. The production of the alkali metal aluminosilicates from calcinated kaolin leads, without any special technical expense, directly to a very fine-particulate product. The kaolin, previously calcinated at from 500° to 800° C., is hydrothermally treated with aqueous alkali metal hydroxide at from 50° to 100° C. The crystallization reaction thereby taking place is generally concluded after from 0.5 to 3 hours.

Commercially available, elutriated kaolins predominatly comprise the clay mineral kaolinite of the approximate composition $Al_2O_3.2\ SiO_2.2\ H_2O$ and which has a layer structure. To obtain therefrom by hydrothermal treatment with alkali hydroxide the alkali metal aluminosilicates to be used in accordance with the invention, it is first necessary to destructure the kaolin, this being effected to best advantage by heating the kaolin to temperatures of from 500° to 800° C. for from two to four hours. The X-ray amorphous anhydrous metakaolin is thereby produced from the kaolin. In addition to destructuring the kaolin by calcination, the kaolin can also be destructed by mechanical treatment (grinding) or by acid treatment.

The kaolins usable as starting materials are light-colored powders of great purity; of course, their iron content of from approximately 2000 to 10,000 ppm Fe is substantially higher than the values of from 20 to 100 ppm Fe in the alkali metal aluminosilicates produced by precipitation from alkali metal silicate and alkali metal aluminate solutions. This higher iron content in the alkali metal aluminosilicates produced from kaolin is not disadvantageous, since the iron is firmly bedded in the form of iron oxide in the alkali metal aluminosilicate lattice and is not dissolved out. A sodium aluminosilicate having a cubic, faujasite-like structure is produced during the hydrothermal action of sodium hydroxide on destructured kaolin. Production of such alkali metal aluminosilicates from destructured kaolin with a low iron content is described in U.S. patent application Ser. No. 819,666, filed July 28, 1977, now U.S. Pat. No. 4,089,929 issued May 19, 1978.

Alkali metal aluminosilicates, usable in accordance with the invention, may also be produced from calcinated (destructured) kaolin by hydrothermal treatment with aqueous alkali metal hydroxide with the addition of silicon dioxide or a compound producing silicon dioxide. The mixture of alkali metal alumino-silicates of differing crystal structure, generally obtained thereby, comprises very fine-particulate crystal particles having a diameter of less than 20μ, and up to 100% of which usually comprises particles having a diameter of less than 10μ. In practice, this conversion of the destructured kaolin is effected preferably with aqueous sodium hydroxide and water glass. A sodium aluminosilicate J is thereby produced which is known by several names in the literature, for example, Molecular Sieve 13X or zeolite NaX (see, O. Grubner, P. Jiru and M. Ralek, "Molecular Sieves", Berlin 1968, page 32, 85–89), when the preparation is preferably not agitated during the hydrothermal treatment at all events, when only low shearing energies are used, and the temperature preferably remains at 10° to 20° C. below the boiling temperature (approximately 103° C.). The sodium aluminosilicate J has a cubic crystal structure similar to that of natural faujasite. The conversion reaction may be influenced particularly by agitating the preparation, at elevated temperature (boiling heat at normal pressure or in an autoclave) and greater quantities of silicate, that is, by a molar preparation ratio $SiO_2$: $Na_2O$ at least 1, particularly 1.0 to 1.45, such that sodium aluminosilicate F is produced in addition to, or instead of, sodium aluminosilicate J. Sodium aluminosilicate F is designated "zeolite P" or "type B" in the literature (see D. W. Breck, "Zeolite Molecular Sieves", New York, 1974, page 72). Sodium aluminosilicate F has a structure similar to the natural zeolites gismodine and garronite and is present in the form of crystallites having an externally spherical appearance. In general, the conditions for producing the sodium aluminosilicate F and for producing mixtures of J and F are less critical than those for a pure crystal type A.

The above-described types of different alkali metal aluminosilicates can also be produced without difficulties in a coarser form with particle sizes of from more than 25μ to 5 mm, in addition to the finely-divided form with particles sizes of from 0.2 to 25μ. This can be done either by omitting the measures that prevent large crystal growth or agglomeration, or by transforming the finely-divided product subsequently in known manner into the granulated form. The desired particle size can be adjusted subsequently, if desired, by grinding and air sifting.

For use in a tanning process to produce dressed fur skins, aluminosilicates also can be used where Cat in the above formula denotes an alkali metal ion and/or a bivalent and/or trivalent cation, where Cat consists at least of 20% of alkali metal ions, preferably sodium ions, x denotes a number of from 0.7 to 1.5, n a number of 1 to 3, y a number of from 0.8 to 6, preferably from 1.3 to 4, with a particle size of from 0.1μ to 5 mm, and a calcium binding power of from 20 to 200 mg CaO/gm of anhydrous active substance when measured according to the Calcium Binding Power Test Method.

For the production of aluminosilicates containing bivalent or trivalent cations, the above-mentioned reactions for the preparation of the alkali metal aluminosilicates can be carried out in some cases with aluminates or silicates which already contain the corresponding cations in salt form. In general, corresponding aluminosilicates are obtained in known manner by ion exchange from alkali metal aluminosilicates with polyvalent cations, e.g., calcium, magnesium, zinc or aluminum ions.

Examples of aluminosilicates, where the alkali metal cations are partly replaced by polyvalent cations, particularly calcium, magnesium, or zinc ions, are represented by the following formulas, bound water not shown:

| |
|---|
| $0.8\ CaO\ .\ 0.2\ Na_2O\ .\ Al_2O_3\ .\ 2\ SiO_2$, |
| $0.4\ CaO\ .\ 0.5\ Na_2O\ .\ Al_2O_3\ .\ SiO_2$, |
| $0.18\ MgO\ .\ 0.77\ Na_2O\ .\ Al_2O_3\ .\ 1.9\ SiO_2$, |
| $0.16\ MgO\ .\ 0.8\ Na_2O\ .\ Al_2O_3\ .\ 2.05\ SiO_2$, |
| $0.11\ ZnO\ .\ 0.92\ Na_2O\ .\ Al_2O_3\ .\ 2\ SiO_2$. |

The products contain from about 8 to 27% by weight of bound water. They can be used in their crystalline, as well as in their amorphous forms.

Other aluminosilicates suitable for use according to the invention are those where Cat in the above formula denotes an alkali metal ion and/or a bivalent and/or trivalent cation, x a number from 0.5 to 1.8, y a number from 0.8 to 6, preferably from 1.3 to 4, with a particle size of from 1.0μ to 5 mm, and a calcium binding power of from 0 to <20 mg CaO/gm of anhydrous active substance.

Among the aluminosilicates of this group are amorphous, crystalline, synthetic, and natural products. They can be synthetized in a simple manner, for example, by reacting water-soluble silicates with water-soluble aluminates in the presence of water, as it was described principally in the preceding production methods. As examples of such products we mention the following aluminosilicates:

| | |
|---|---|
| 1.05 $Na_2O$ . $Al_2O_3$ . 3.8 $SiO_2$ | Ca binding power 0 mg CaO/gm |
| 1.0 $Na_2O$ . $Al_2O_3$ . 2.1 $SiO_2$ | Ca binding power 16 mg CaO/gm |
| 0.05 $Na_2O$ . 0.94 CaO . $Al_2O_3$ SiO | Ca binding power <15 mg CaO/gm |
| 0.09 $Na_2O$ . 0.82 MgO . $Al_2O_3$ . 2.38 $SiO_2$ | Ca binding power <15 mg CaO/gm |

Also suitable for use according to the invention are aluminosilicates where Cat in the above formula denotes an alkali metal ion and/or a bivalent and/or trivalent cation, x a number of from 0.5 to 1.8, y a number of from >6 to 50, preferably from >6 to 20, with a particle size of from 0.1μ to 5 mm, and a calcium-binding power of from 0 to 200 mg CaO/gm anhydrous substances according to the Calcium Binding Power Test Method.

These aluminosilicates can be amorphouse or crystalline and be of synthetic or natural origin. They can be synthetized in a simple manner, such as, by reacting water-soluble silicates with water-soluble aluminates in the presence of water. To this end aqueous solutions of the starting material can be mixed with each otheer, or one component, which is present in solid form, can be reacted with the other component, which is present as an aqueous solution. The introduction of polyvalent cations can be effected according to methods known from the literature by exchanging monovalent cations, for example, sodium ions, with bivalent and trivalent cations, such as calcium, magnesium, zinc or aluminum ions. The natural aluminosilicates can also contain other cations in a fluctuating, mostly small amount in addition to the above-mentioned cations. Among these are alkali metals such as lithium and potassium; thallium; maganese; cobalt; and nickel ions. Synthetic aluminosilicates can also contain, as cations, quaternary nitrogen compounds, such as ammonium ions, in varying amounts. The extent to which the aluminosilicates are laden with the above-mentioned cations depends largely on the size of the coefficient of selectivity. Preferably, however, aluminosilicates of the above-indicated general composition are used, where Cat in the above-mentioned formula is an alkali metal ion, preferably a sodium ion. Examples of these products are represented by the following formulas:

$1.3Na_2O.Al_2O_3.13.4SiO_2$ $0.6Na_2O.Al_2O_3.8.3SiO_2$ $1.1Na_2O.Al_2O_3.14.8SiO_2$ $1.5Na_2O.Al_2O_3.12.2SiO_2$ $1.5Na_2O.Al_2O_3.11.8SiO_2$

An essential criterion for the usability of all the above mentioned aluminosilicates according to the invention is their at least partial acid solubility in the pH range of from 2.5 to 5, preferably from 3.5 to 4.5. The products that meet this requirement are at least partly dissolved by a solution of 2.5 ml concentrated formic acid in 100 ml water. This acid solubility test is carried out as follows:

A suspension of 2 gm of aluminosilicates (related to the anhydrous active substance) in 100 ml of distilled water is mixed slowly under stirring in the course of from 8 to 30 minutes at a temperature of 22° C. with 2 ml of concentrated formic acid. For aluminosilicates that can be used according to the invention, the pH value, of the suspension after the total addition of the 2 mg formic acid must be above 2.5, between 2.5 and 5.5, and preferably between 3.5 and 4.5. If these pH values are attained in the titration, we have an aluminosilicate which is suitable for use according to the invention in view of its acid binding power. Products where a pH value outside this range is found according to this meethod, have either a too low acid binding power or a too high alkalinity, and are not usuable in the sense according to the invention. For strict neutralizing purposes, which are not the subject of the present invention, aluminosilicates with a higher alkalinity can also be used.

The calcium binding power, i.e., complexing capacity, can be determined according to the Calcium Binding Power Test, which is as follows:

One liter of an aqueous solution containing 0.594 g $CaCl_2$ (300 mg CaO/l=30° dH) (German hardness degrees), and standardized with diluted NaOH to a pH value of 10, is mixed with 1 gm of the aluminosilicate, calculated as an anhydrous product. Then the suspension is stirred vigorously for 15 minutes at a temperature of 22° C. After filtering off the aluminosilicate, the residual hardness x of the filtrate is determined, from which the calcium binding power is calculated in mg CaO/gm of aluminosilicate according to the formula: (30-x)=10.

The following preparations and examples are illustrative of the practice of the invention without being limitative in any manner.

PREPARATIONS

I. The production of suitable alkali metal aluminosilicates

The silicate solution was added to the aluminate solution under vigorous agitation in a vessel having a capacity of 15 liters. Agitation was effected at 3000 r.p.m. by means of an agitator having a dispersing disc. The two solutions were at room temperature. An X-ray amorphous sodium aluminosilicate was formed as a primary product of recipitation with an exothermic reaction. After agitating for 10 minutes, the suspension of the precipitation product was transferred to a crystallizer and, for the purpose of crystallization, remained in the crystallizer for 6 hours at 90° C. under agitation (250 r.p.m.). The mother liquor was drawn off from the crystal sludge and the filtration residue was washed with deionized water until the washing water flowing off had a pH value of approximately 10. Therefore the washed filtration residue was dried as specified. Instead of the dried sodium aluminosilicate, the suspension of the crystallization product or the crystal sludge was also used to produce the auxiliary soaping agents. The water contents were determined by heating the predried products to 800° C. for 1 hour. The sodium aluminosilicates, washed or neutralized to the pH value of approximately 10, and then dried, were subsequently ground in a ball mill. The grain size distribution was determined by means of a sedimentation balance.

Conditions for producing sodium aluminosilicate A

| | |
|---|---|
| Precipitation: | 2.985 kg of aluminate solution of the composition: 17.7% $Na_2O$, 15.8% $Al_2O_3$, 66.6% $H_2O$ 0.15 kg of caustic soda 9.420 kg of water 2.445 kg of a 25.8% sodium silicate solution of the composition 1 $Na_2O$ . 6.0 $SiO_2$, freshly prepared from a commercial sodium silicate and silicic acid that is readily soluble in alkali |
| Crystallization: | 6 hours at 90° C. |
| Drying: | 24 hours at 100° C. |
| Composition: | 0.9 $Na_2O$ . 1 $Al_2O_3$ . 2.04 $SiO_2$ . 4.3 $H_2O$ (= 21.6% $H_2O$) |
| Degree of crystallization: | Fully crystalline. |
| Calcium binding power: | 170 mg CaO/gm active substance. |

The particle size distribution, determined by sedimentation analysis, resulted in a mixture range of the particle size distribution curve at 3 to 6μ.

The sodium aluminosilicate A exhibits the following interference lines in the X-ray diffraction graph:

| d values, photographed with Cu-$K_\alpha$ *radiation in A* |
|---|
| 1 |
| — |
| 12.4 |
| — |
| 8.6 |
| 7.0 |
| — |
| 4.1 (+) |
| — |
| 3.68 (+) |
| 3.38 (+) |
| 3.26 (+) |
| 2.96 (+) |
| — |
| — |
| 2.73 (+) |
| — |
| 2.60 (+) |

It is quite possible that all these interference lines will not appear in the X-ray diffraction graph particularly when the aluminosilicates are not fully crystallized. Thus, the most important d values for characterizing these types have been characterized by a "(+)".

Conditions for producing sodium aluminosilicate B

| | |
|---|---|
| Precipitation: | 7.63 kg of an aluminate solution of the composition 13.2% $Na_2O$; 8.0% $Al_2O_3$; 78.8% $H_2O$; 2.37 kg of a sodium silicate solution of the composition 8.0% $Na_2O$; 26.9% $SiO_2$; 65.1% $H_2O$; |
| Preparation ratio in mol: | 3.24 $Na_2O$; 1.0 $Al_2O_3$; 1.78 $SiO_2$; 70.3 $H_2O$; |
| Crystallization: | 6 hours at 90° C.; |
| Drying: | 24 hours at 100° C.; |
| Composition of the dried product | 0.99 $Na_2O$ . 1.00 $Al_2O_3$ . 1.83 $SiO_2$ . 4.0 $H_2O$; (= 20.9% $H_2O$) |

-continued

| | |
|---|---|
| Crystalline form: | Cubic with greatly rounded corners and edges; |
| Average particle diameter: | 5.4μ |
| Calcium binding power: | 172 mg CaO/gm active substance. |

Conditions for producing sodium aluminosilicate C

| | |
|---|---|
| Precipitation: | 12.15 kg of an aluminate solution of the composition $Na_2O$; 5.4% $Al_2O_3$; 80.1% $H_2O$; 14.5% 2.87 kg of a sodium silicate solution of the composition 8.0% $Na_2O$; 26.9% $SiO_2$; 65.1% $H_2O$; |
| Preparation ratio in mol: | 5.0 $Na_2O$; 1.0 $Al_2O_3$; 2.0 $SiO_2$; 100 $H_2O$; |
| Crystallization: | 1 hour at 90° C.; |
| Drying: | Hot atomization of a suspension of the washed product (pH 10) at 295° C.; Content of solid substance in the suspension 46%; |
| Composition of the dried product: | 0.96 $Na_2O$ . 1 $Al_2O_3$ . 1.96 $SiO_2$ . 4 $H_2O$; |
| Crystalline form: | Cubic with greatly rounded corners and edges; Water content 20.5%; |
| Average particle diameter: | 5.4μ |
| Calcium binding power | 172 mg CaO/gm active substance. |

Conditions for producing potassium aluminosilicate D

The sodium aluminosilicate C was produced in the first instance. After the mother liquor had been drawn off, and the crystalline mass had been washed to the pH value 10 with demineralized water, the filtration residue was suspended in 6.1 l of a 25% KCl solution. The suspension was heated for a short time to 80° to 90° C., and was then cooled, filtered off again and washed.

| | |
|---|---|
| Drying: | 24 hours at 100° C.; |
| Composition of the dried product: | 0.35 $Na_2O$ . 0.66 $K_2O$ . 1.0 $Al_2O_3$ . 1.96 $SiO_2$ . 4.3 $H_2O$; (water content 20.3%) |

Conditions for producing sodium aluminosilicate E

| | |
|---|---|
| Precipitation: | 0.76 kg of aluminate solution of the composition: 36.0% $Na_2O$, 59.0% $Al_2O_3$, 5.0% water 0.94 kg of caustic soda; 9.94 kg of water; 3.94 kg of a commercially available sodium silicate solution of the composition: 8.0% $Na_2O$, 26.9% $SiO_2$, 65.1% $H_2O$; |
| Crystallization: | 12 hours at 90° C.; |
| Drying: | 12 hours at 100° C.; |
| Composition: | 0.9 $Na_2O$ . 1 $Al_2O_3$ . 3.1 $SiO_2$ . 5 . $H_2O$; |
| Degree of crystallization: | Fully crystalline. |
| The maximum range of the particle size distribution curve at 3 to 6μ. | |
| Calcium binding power: | 110 mg CaO/gm active substance. |

The aluminosilicate E exhibited the following interference lines in the X-ray diffraction graph:

| d-values, photographed with Cu-$K_\alpha$ radiation in A |
|---|
| 14.4 |

-continued

| d-values, photographed with Cu-$K_\alpha$ radiation in A |
|---|
| — |
| 8.8 |
| — |
| — |
| 4.4 |
| — |
| 3.8 |
| — |
| — |
| — |
| — |
| 2.88 |
| 2.79 |
| — |
| 2.66 |
| — |

Conditions for producing sodium aluminosilicate F

| | |
|---|---|
| Precipitation: | 10.0 kg of an aluminate solution of the composition: 0.84 kg $NaAlO_2$ + 0.17 kg NaOH + 1.83 kg $H_2O$; 7.16 kg of a sodium silicate solution of the composition 8.0% $Na_2O$, 26.9% $SiO_2$, 65.1% $H_2O$; |
| Crystallization: | 4 hours at 150° C.; |
| Drying: | Hot atomization of a 30% suspension of the washed product (pH 10); |
| Composition of the dried product: | 0.98 $Na_2O$ : 1 $Al_2O_3$ . 4.12 $SiO_2$ . 4.9 $H_2O$; |
| The particles were of spherical shape; the average diameter of the balls was approximately 3 to 6μ. | |
| Calcium binding power: | 132 mg CaO/gm active substance at 50° C. |

Conditions for producing sodium aluminosilicate G

| | |
|---|---|
| Precipitation: | 7.31 kg aluminate (14.8% $Na_2O$, 9.2% $Al_2O_3$, 76.0% $H_2O$) 2.69 kg silicate (8.0% $Na_2O$, 26.9% $SiO_2$, 65.1% $H_2O$); |
| Preparation ratio in mol: | 3.17 $Na_2O$, 1.0 $Al_2O_3$, 1.82 $SiO_2$, 62.5 $H_2O$; |
| Crystallization: | 6 hours at 90° C.; |
| Composition of the dried product: | 1.11 $Na_2O$ . 1 $Al_2O_3$ . 1.89 $SiO_2$, 3.1 $H_2O$ (= 16.4% $H_2O$); |
| Crystalline structure: | Mixed structural type in the ratio 1:1; |
| Crystalline form: | Rounded crystallites; |
| Average particle diameter: | 5.6μ. |
| Calcium binding power: | 105 mg CaO/gm active substance at 50° C. |

Conditions for producing sodium aluminosilicate H produced from kaolin

1. Destructuring Kaolin

In order to activate the natural kaolin, samples of 1 kg were heated to 700° C. in a Schammote crucible for 3 hours. The crystalline kaolin $Al_2O_3.2\ SiO_2.2\ H_2O$ was thereby converted to the amorphous metakaolin $Al_2O_3.2\ SiO_2$.

2. Hydrothermal treatment of metakaolin

The alkali solution was placed in an agitating vessel and the calcined kaolin was added under agitation at temperatures between 20° and 100° C. The suspension was brought to the crystallization temperature of 70° to 100° C. under agitation, and was maintained at this temperature until the crystallization operation had terminated. The mother liquor was subsequently drawn off and the residue was washed with water until the washing water draining off had a pH value of from 9 to 11. The filter cake was dried and was subsequently crushed to a fine powder or was ground to remove the agglomerates produced during drying. This grinding process was omitted when the filtration residue was further processed in a wet state or when the drying operation was performed by means of a spray dryer or a flow dryer. Alternatively, the hydrothermal treatment of the calcined kaolin can be performed in a continuous operation.

| | |
|---|---|
| Preparation: | 1.65 kg of calcined kaolin 13.35 kg of 10% NaOH, mixed at room temperature; |
| Crystallization: | 2 hours at 100° C.; |
| Drying: | 2 hours at 160° C. in a vacuum drying cabinet; |
| Composition: | 0.88 $Na_2O$ . 1 $Al_2O_3$ . 2.14 $SiO_2$ . 3.5 $H_2O$ (= 18.1% $H_2O$); |
| Crystalline structure: | Mixed structural type like Na aluminosilicate G, although in the ratio 8:2. |
| Average particle diameter: | 7.0μ. |
| Calcium binding power: | 126 mg CaO/gm active substance. |

Conditions for producing sodium aluminosilicate J produced from kaolin:

The destructuring of the kaolin and the hydrothermal treatment were effected in the same manner as in the case of H.

| | |
|---|---|
| Preparation: | 2.6 kg of calcined kaolin, 7.5 kg of 50% NaOH, 7.5 kg of water glass, 51.5 kg of deionized water, mixed at room temperature; |
| Crystallization: | 24 hours at 100° C., without agitation; |
| Drying: | 2 hours at 160° C. in a vacuum drying cabinet; |
| Composition: | 0.93 $Na_2O$ . 10 $Al_2O_3$ . 3.60 $SiO_2$ . 6.8 $H_2O$ (= 24.6% $H_2O$); |
| Crystalline structure: | Sodium aluminosilicate J in accordance with above definition, cubic crystallites; |
| Average particle diameter: | 8.0 μ |
| Calcium binding power: | 105 mg CaO/gm active substance. |

Preparation of sodium aluminosilicate K in granulated form:

For the preparation of the granulated alkali metal aluminosilicates utilizable according to the invention, dried, finely-divided crystalline aluminosilicates which still contained 15 to 25% bound water were employed as starting materials.

Fifty kg of a powdered, crystalline, dried aluminosilicate of the composition 0.9 mole $Na_2O$. 1 mole $Al_2O_3$.2.04 moles $SiO_2$.4.3 moles $H_2O$ (aluminosilicate A), were suspended in a 300 l agitator vessel with 180 l water, and standardized to a pH value of 6 with 25% hydrochloric acid. This suspension was stirred moderately for 40 minutes. Then the aluminosilicate was separated on a vacuum filter, and the filter cake was washed out three times with 20 l water each. The aluminosilicate was dried in a drying cabinet for 10 hours at 105° C.

This dried aluminosilicate was mixed with 10 kg of benonite and 20.1 kg of water, which had been standardized to a pH value of 6 with 25% hydrochloric acid, and the mixture was homogenized for 20 minutes in a 100 kg "Loedige" mixer (blade mixer by Loedige). Under continued mixing and gradual addition of 13.5 kg of additional water, which had likewise been standardized to a pH of 6 with 25% hydrochloric acid, within another 8 minutes the desired granulated product was obtained.

The granulated material was dried in a drying cabinet for 60 minutes at 150° C. and solidified by subsequent heating (15 minutes at 780° C.).

In order to determine the exchange power, 1 gm of the granulated material was boiled in 500 ml tap water of 16° dH for 5 minutes. After cooling and filtering, the residual hardness of the resultant filtrate was determined as discussed above. The calcium binding power of the product was 120 mg CaO/gm active substance. The particle size was 0.08 to 2 mm.

When an Eirich turbo mixer (pan/turbo mixer by Eirich) was used, the required homogenization and granulation periods were shorter. When the above-described procedure was used for the preparation of sodium aluminosilicate A in granulated form, the homogenization and the granulation were already completed after 5 minutes (instead of 28 minutes in the blade mixer). After drying for 15 minutes at 100° C. and calcining for 5 minutes at 800° C. in an air muffle furnace, a granulated product was obtained with a good exchange power, good hot water resistance, and good grain stability.

The calcium binding power of the product was 110 mg CaO/gm of active substance. The particle size was 0.08 to 2 mm.

In a corresponding manner, other granulated products of alkali metal aluminosilicates can also be prepared with particle sizes of more than 25μ to 5 mm, if alkali metal aluminum silicates of the types B to J are treated according to the above-described procedure.

Other granulating methods, like those described in U.S. Pat. No. 3,356,450 and German Pat. No. 1,203,238 are also suitable for the preparation of the alkali metal aluminosilicates to be used according to the invention.

Preparation of aluminosilicate L

A product of the composition 0.98 $Na_2O$. $Al_2O_3$.1.96 $SiO_2$.4.2 $H_2O$, prepared according to the instructions for alkali metal aluminosilicate C, was suspended in a solution containing calcium chloride. Under exothermic reaction, sodium was exchanged against calcium. After a reaction time of 15 minutes, the product was filtered off and washed, then spray-dried at an atomization temperature of 198° to 250° C. by hot atomization of a 40% suspension. The product obtained had the following characteristics:

| | |
|---|---|
| Composition: | 0.28 $Na_2O$ . 0.7 CaO . $Al_2O_3$ . 1.96 $SiO_2$ . 4 $H_2O$ |
| Calcium binding power: | >20 mg CaO/gm of active substance |
| Particle size: | Mean particle diameter: 5.8 μ |
| Crystal form: | A-type, crystalline |

Preparation of aluminosilicate M

An aluminosilicate of the composition 0.89 $Na_2O$. $Al_2O_3$. 2.65 $SiO_2$. 6 $H_2O$ was suspended in a solution containing magnesium chloride. After a reaction time of 30 minutes at 80° to 90° C., the product was filtered off and washed. The drying was effected as shelf-drying for 16 hours at 100° C. The product obtained had the following characteristics:

| | |
|---|---|
| Composition: | 0.42 $Na_2O$ . 0.47 MgO . $Al_2O_3$ . 2.61 $SiO_2$ . 5.6 $H_2O$ |
| Calcium binding power: | >25 mg CaO/gm of active substance |
| Particle size: | Average particle diameter: 10.5 μ |

Preparation of aluminosilicate N

An X-ray amorphous aluminosilicate of the composition 1.03 $Na_2O$. $Al_2O_3$. 2.14 $SiO_2$. 5.8 $H_2O$ was treated in the manner described under aluminosilicate M in a solution containing zinc sulfate; subsequently it was washed and dried under mild conditions. The product obtained had the following characteristics:

| | |
|---|---|
| Composition: | 0.92 $Na_2O$ . 0.11 ZnO . $Al_2O_3$ . 1.98 $SiO_2$ . 6 $H_2O$ |
| Calcium binding power: | 76 mg CaO/gm of active substance |
| Particle size: | Average particle diameter: 36 μ |

Preparation of aluminosilicate O

Fifty kg of aluminosilicate L were suspended in a 300 l agitator vessel with 180 l water and standardized with 25% hydrochloric acid to a pH of 6. The suspension was stirred moderately vigorously for 40 minutes. Then the aluminosilicate was filtered off, washed repeatedly with water and dried for 10 hours at 105° C. The dried aluminosilicate was mixed with 10 kg of bentonite, and 20 l of water, which had been standardized with 25% hydrochloric acid to a pH of 6, and homogenized in a 100 kg blade mixer for 20 minutes. A granulated product was obtained within another 8 minutes under stirring, by adding gradually 13.5 l water, which had been standardized to a pH of 6. The granulated product was dried for 60 minutes at 150° C. and solidified by heating for 15 minutes to 780° C. The particle size distribution of the aluminosilicate O thus obtained was from 1 to 2 mm.

Preparation of aluminosilicate P

In a vessel of 1.5 l capacity, were charged 80 gm of a 15% solution of hexadecyl-trimethyl-ammonium chloride and 140 gm of a 35% silicon silicate ($Na_2O$:$SiO_2$=1:3.4), dissolved in 550 ml water. Under vigorous mixing, 46 gm of sodium aluminate (38% $Na_2O$, 52% $Al_2O_3$), dissolved in 150 ml water, and immediately thereafter 43.9 gm of $MgSO_4$. 7 $H_2O$, dissolved in 100 gm of water, were added. After stirring for 3 hours, the product thus formed was filtered off, washed with water, and the filter residue was dried for 35 hours at 100 torr and 80° C. The product obtained had the following characteristics:

| | |
|---|---|
| Composition: | 0.6 $Na_2O$ . 0.24 MgO . 0.83 $Al_2O_3$ . 2.0 $SiO_2$ . 4.8 $H_2O$ and 7% hexadecyl-trimethyl-ammonium chloride |
| Calcium binding power: | 84 mg CaO/gm of active substance |
| Particle size: | Average particle diameter: 16 μ (after grinding) |

Preparation of aluminosilicate Q

In a vessel of 1.5 l capacity were charged 142.9 gm of a 35% sodium silicate ($Na_2O:SiO_2=1:3.4$), dissolved in 507.4 gm of water, and mixed under stirring with 48.3 gm of sodium aluminate (38% $Na_2O$, 52% $Al_2O_3$), dissolved in 150 gm of water. Subsequently 42.4 gm of $Al_2(SO_4)_3.18\ H_2O$, dissolved in 100 gm of water, were added and then, after stirring for 10 minutes, 8 gm of a 50% solution of sodium dodecyl-benzene sulfonate were added. After stirring for another 160 minutes, the suspension was treated as described under aluminosilicate P. The product obtained of the composition 1.0 $Na_2O.\ Al_2O_3.\ 2.1\ SiO_2.\ 4.1\ H_2O$ with 2.1% sodium dodecyl-benzene sulfonate, with a calcium binding power of 128 mg CaO/gm of active substance and an average particle diameter of 19μ, was treated for 30 minutes at 60° C. with a diluted aluminum sulfate solution. After filtration, washing and subsequent drying at 80 torr and 100° C. for 6 hours, the solid substance was ground. The product obtained had the following characteristics:

| | |
|---|---|
| Composition: | 0.59% $Na_2O$ . 1.1 $Al_2O_3$ . 1.98 $SiO_2$ . 4.9 $H_2O$ |
| Calcium binding power: | 56 mg CaO/gm of active substance |
| Particle size: | Average particle diameter: 50 μ |

The aluminosilicates, where Ca in the above formula denotes an alkali metal ion and/or a bivalent and/or trivalent cation, × a number from 0.5 to 1.8, where the particle size is 0.1μ to 5 mm, y denotes, on the one hand, a number from 0.8 to 6 with a calcium binding power of 0 to <20 mg and, on the other hand, a number from >6 to 50 with a calcium binding power of 0 to 200 mg CaO/gm of anhydrous active substance, can be prepared principally in the same manner as indicated in the above-described production methods. Beyond that, a part of the products are naturally occurring aluminosilicates.

Preparation of aluminosilicate R

In a vessel of 15 l capacity, an aluminate solution of the composition 0.84 kg $NaAlO_2$, 0.17 kg NaOH, 1.83 kg $H_2O$, was mixed with 7.16 kg of a sodium silicate solution (8.0% Na20, 26.9% $SiO_2$, 65.1% $H_2O$). The stirring was done with a beam stirrer at 300 rpm. Both solutions were charged at room temperature. An X-ray amorphous sodium aluminosilicate was formed as a primary precipitation product. After stirring for 10 minutes, the suspension of the precipitation product was transferred to a crystallization vessel in which it remained for 8 hours under vigorous stirring (500 rpm) at 150° C. to effect the crystallization. After draining the liquor from the crystal sludge and washing with water until the outflowing water had a pH of about 11, the about 36% suspension of the washed product was dried by hot atomization. The product obtained, a synthetic crystalline zeolite (Analcite), had the following characteristics:

| | |
|---|---|
| Composition: | 1.05 $Na_2O$ . $Al_2O_3$ . 3.8 $SiO_2$ |
| Calcium binding power: | 0 mg CaO/gm of active substance |
| Average particle diameter: | 12.3 μ |

Preparation of aluminosilicate S

The preparation was similar to that indicated for aluminosilicate R, except that 6.91 kg of aluminate (18.0% $Na_2O$, 11.2% $Al_2O_3$, 70.8% $H_2O$) and 3.09 kg of silicate (8.0% $Na_2O$, 26.9% $SiO_2$, 65.1% $H_2O$) were used for the precipitation. The crystallization of the precipitation product was effected at 100° C. for 4 hours. After washing, the filter cake was dried for 24 hours at 100° C. and subsequently crushed to a fine powder. The product obtained, a feldsparoid hydrosodalite, had the following characteristics:

| | |
|---|---|
| Composition: | 1 $Na_2O$ . $Al_2O_3$ . 2.1 $SiO_2$ |
| Calcium binding power: | 16 mg CaO/gm of active substance |
| Average particle diameter: | 6.1 μ |

Preparation of aluminosilicate T

For the preparation of the aluminosilicate containing calcium ions, the 44% suspension of a crystalline sodium aluminosilicate of the composition 1.05 $Na_2O.Al_2O_3.1.93\ SiO_2$ was reacted with a concentrated calcium chloride solution. After filtering off the product laden with about 70% calcium, this process was repeated at 60° C. After drying, the product obtained had the following characteristics:

| | |
|---|---|
| Composition: | 0.5 $Na_2O$ . 0.94 CaO . $Al_2O_3$ . 1.92 $SiO_2$ |
| Active substance content: | 79% |
| Calcium binding power: | <15 mg CaO/gm of active substance |

Preparation of aluminosilicate U

For the preparation of the aluminosilicate containing magnesium ions, a 40% suspension of a crystalline sodium aluminosilicate of the composition 0.92 $Na_2O.Al_2O_3.2.39\ SiO_2$ was reacted with a concentrated magnesium sulfate solution at 80° to 90° C. for 30 minutes. After filtering off the product laden with magnesium, the treatment was repeated again. After drying, the product had the following characteristics:

| | |
|---|---|
| Composition: | 0.09 $Na_2O$ . 0.82 MgO . $Al_2O_3$ . 2.38 $SiO_2$ |
| Active substance content: | 78% |
| Calcium binding power: | <15 mg CaO/gm of active substance |

Preparation of aluminosilicate V

This aluminosilicate is a synthetic zeolite (Mordenite) where y has a value of >6 according to the abovementioned formula. The preparation of these aluminosilicates is described more in detail in the monography by Donald W. Breck, "Zeolites, Molecular Sieves", Wiley & Sons, New York. The synthetic Mordenite is prepared from the reaction components sodium aluminate and silica, at temperatures between 265° and 295° C. for 2 to 3 days and yields a product of the following composition:

$$1.0\ Na_2O.Al_2O_3.10\ SiO_2.6.7\ H_2O$$

Other aluminosilicates, where y has a value of >6 according to the above-mentioned formula, are characterized below by commercial products.

Aluminosilicate W

Commercial amorphous aluminosilicate, type "Zeolex 23 A" by Huber Corp.

| | |
|---|---|
| Composition: | 1.5 $Na_2O$ . $Al_2O_3$ . 12.2 $SiO_2$ |
| Active substance content: | 82% |
| Calcium binding power: | 40 mg CaO/gm of active substance |

Aluminosilicate X

Commercial amorphous aluminosilicate type "Zeolex 35 P" by Huber Corp.

| | |
|---|---|
| Composition: | 1.5 $Na_2O$ . $Al_2O_3$ . 11.8 $SiO_2$ |
| Active substance content: | 82% |
| Calcium binding power: | 46 mg CaO/gm of active substance |

Aluminosilicate Y

Commercial amorphous aluminosilicate, type "Silteg P 820" by Degussa.

| | |
|---|---|
| Composition: | 1.1 $Na_2O$ . $Al_2O_3$ . 14.8 $SiO_2$ |
| Active substance content: | 80% |
| Calcium binding power: | 36 mg CaO/gm of active substance |

Aluminosilicate Z

Natural zeolite (Clinoptilolite), as it is obtained in large quantities in open pit mining in the Western part of the United States.

| | |
|---|---|
| Composition: | 0.6 $Na_2O$ . $Al_2O_3$ . 8.3 $SiO_2$ |
| Active substance content: | 86% |
| Calcium binding power: | 0 mg CaO/gm of active substance |

The following commercial products of the Anaconda Corp., Denver, Colo., are additional examples of natural aluminum silicates that can be used according to the invention, for which y has a value of >6 according to the above-mentioned formula:

Anaconda, Natural Zeolite

Type 1010: molar ratio $SiO_2/Al_2O_3=9.8$

Type 2020: molar ratio $SiO_2/Al_2O_3=11.4$

Type 3030: molar ratio $SiO_2/Al_2O_3=9.0$

Type 4040: molar ratio $SiO_2/Al_2O_3=7.4$

DRESSING OF SHEEPSKINS

Example 1

Soaking

Sheepskins were rinsed for four hours at 25° C. Then 1 gm/l of an anionic surfactant, preferably sodium sulfosuccinate, was added. The skins were subsequently soaked overnight, followed by fleshing in a conventional manner.

Wash

The sheepskins were milled for two hours in a vat comprising 3 gm/l of a mixture of 40% nonionic tensides such as nonylphenol 9 EO and 60% of a degreasing substance selected from the group of hydroaromatics (e.g., hexalin tetralin or a hydrocarbon such as petroleum)

1 gm/l of an ammonium salt of $C_{12}$–$C_{18}$ alkylsulfates 2 gm/l of a commercial bleaching agent followed by thorough rinsing.

Pickling

The washed sheepskins were tumbled overnight at 30° C. in a pickling liquor comprised of 60 gm/l sodium chloride 4 gm/l of a technical grade dicarboxylic acid, consisting primarily of adipic acid 3 gm/l of 85% formic acid The pH of the pickling liquor was about 3.0.

Tanning

Quantities of 4.8 gm/l of aminosilicates according to preparations A, E, K, P, Q, T or W, were added to the pickling liquor. The sheepskins were tumbled for 3 hours, the pH of the liquor being about 3.9.

Post-Tanning

A dubbin mixture resistant to electrolytes in an amount of 7.0 gm/l was added. The pH was about 4.0. The mixture of sheepskins and liquor was tumbled overnight. The skins were then dried in a conventional manner.

The result was a tanned sheepskin that can be used especially for making white types of sheepskin furs.

A considerably poorer water resistance and a lower shrinkage temperature were obtained in comparison with a method having the same procedure but using 8 gm/l of a commercial aluminum tanning agent instead of an aluminosilicate. Whereas the shrinkage temperature for the tanning with aluminosilicate was 59° C., a shrinkage temperature of only 48° C. was obtained with the basic aluminum tanning agent.

EXAMPLE 2

Soaking as described in Example 1

Prewash

Sheepskins soaked as in Example 1 were tumbled for one hour at 35° C. in a 1:20 liquor ratio. The liquor was comprised of 1.0 gm/l of commercial $C_{12}$-$C_{18}$ alkylsulfate (AS)

1.0 gm/l of one of aluminosilicates A to J 3.0 gm/l of a mixture of phenol

15% nonylphenol 9 EO and 85% petroleum hydrocarbons.

Main wash

The prewashed sheepskins were washed for one hour at about 35° C. in a ratio of 1:20 in a wash liquor comprised of 1 gm/l $C_{12}$–$C_{18}$ commercial alkylsulfate (AS)

1 gm/l of one of aluminosilicates A to J 3 gm/l of a mixture of

15% nonylphenol 9 EO and 85% petroleum hydrocarbons.

1 gm/l of a commercial fur skin bleaching agent in combination with optical brighteners The skins were rinsed at about 35° C.

Pickling

Washed sheepskins were tumbled overnight in a pickling liquor having a pH of about 3.0 and a temperature of 30° C. The liquor was comprised of 60 gm/l sodium chloride 4 gm/l of technical grade, about 90%, acetic acid.

3 gm/l of 85% formic acid.

Tanning

An aluminosilicate selected from aluminosilicates B,C,F,L,M,N,O,R and T was added to the pickling liquor in an amount of 5 gm/l, and the tanning both was operated for three hours. Then, 7 gm/l of a commercial electrolyte-resistant dubbin mixture were added, the pH of the liquor being 4.0. The sheepskins were tanned overnight and subsequently dried in a conventional manner.

A definitely more water-resistant tanned sheepskin with a higher shrinkage temperature of 58° C. was obtained. In contrast, a shrinkage temperature of only 47° C. was obtained by tanning with a commercial basic aluminum tanning agent in an amount of 8 gm/l.

Any of the above recited aluminosilicates may be replaced by the described aluminosilicates with substantially equal results.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. In the process of tanning for the production of dressed fur skins comprising subjecting fur skins to the action of an aqueous liquor containing tanning agent, the improvement which comprises adding to a pickling bath having a pH of from about 2.5 to 3.5, as sole tanning agent, from about 1 to 50 gm/l of a water-insoluble aluminosilicate of the formula $$(Cat_{2/n}O)_x.Al_2O_3.(SiO_2)_y$$

wherein Cat represents a cation selected from the group consisting of alkali metals, bivalent metal ions, trivalent metal ions, and mixtures thereof; n represents an integer from 1 to 3 of the valence of the cation; x is a number of from 0.5 to 1.8; and y is a number of from 0.8 to 50, said aluminosilicate having an average particle size in the range of from 0.1μ to 5 mm and a calcium binding power of from 0 to 200 mg CaO/gm of anhydrous active substance measured at 22° C. according to the Calcium Binding Power Test Method.

2. The process of claim 1 wherein y is a number of from 1.3 to 20.

3. The process of claim 1 wherein Cat represents an alkali metal ion; x is a number of from 0.7 to 1.5; and y is a number of from 0.8 to 6; the aluminosilicate being hydrated and having a particle size from 0.1 to 25μ and a calcium-complexing capacity of from 20 to 200 mg CaO/gm of anhydrous active substance.

4. The process of claim 3 wherein Cat represents a sodium ion, y is a number of from 1.3 to 4, and the aluminosilicate has a particle size of from 1 to 12μ.

5. The process of claim 1 wherein Cat represents an alkali metal ion; x is a number of from 0.7 to 1.5; and y is a number of from 0.8 to 6, the aluminosilicate being hydrated and having a particle size of from more than 25μ to 5 mm and a calcium-complexing capacity of from 20 to 200 mg CaO/gm of anhydrous active substance.

6. The process of claim 5 wherein Cat represents a sodium ion and y is a number of from 1.3 to 4.

7. The process of claim 1 wherein Cat represents an alkali metal ion, a divalent cation, a trivalent cation, or a mixture thereof; Cat comprises at least 20 mol% of alkali metal ions; x represents a number of from 0.7 to 1.5; n is a number from 1 to 3; and y is a number of from 0.8 to 6, the aluminosilicate being hydrated and having a particle size of from 0.1μ to 5 mm and a calcium complexing capacity of from 20 to 200 mg CaO/gm of anhydrous active substance.

8. The process of claim 7 wherein Cat represents a sodium ion and y is a number of from 1.3 to 4.

9. The process of claim 1 wherein Cat represents an alkali metal ion, a divalent cation, a trivalent cation, or a mixture thereof; x is a number of from 0.5 to 1.8; y is a number of from 0.8 to 6, the aluminosilicate being hydrated and having a particle size of from 0.1μ to 5 mm and a calcium-complexing capacity of from 0 to <20 mg CaO/gm anhydrous active substance.

10. The process of claim 9 wherein y is from 1.3 to 4.

11. The process of claim 1 wherein Cat represents an alkali metal ion, a divalent cation, a trivalent cation, or a mixture thereof; x is a number of from 0.5 to 1.8; and y is a number of from 6 to 50, the aluminosilicate being hydrated and having a particle size of from 0.1μ to 5 mm and a calcium-complexing capacity of from 0 to 200 mg CaO/gm of anhydrous active substance.

12. The process of claims 1,3,7,9, or 11 wherein Cat represents a sodium ion, an earth alkali metal ion, a zinc ion, an aluminum ion, or a mixture thereof.

13. The process of claim 11 wherein Cat is a calcium or magnesium ion.

14. In the process of tanning for the production of dressed fur skins comprising subjecting pickled fur skins to the action of an aqueous liquor containing tanning agent, the improvement which comprises employing as tanning agent from 1 to 50 gm/l of a water-insoluble aluminosilicate of the formula $$(Cat_{2/n}O)_x.Al_2O_3.(SiO_2)_y$$

wherein Cat represents a cation selected from the group consisting of alkali metals, bivalent metal ions, trivalent metal ions, and mixtures thereof; n represents an integer from 1 to 3 of the valence of the cation; x is a number of from 0.5 to 1.8; and y is a number of from 0.8 to 50, said aluminosilicate having an average particle size in the range of from 0.1μ to 5 mm, a calcium binding power of from 0 to 200 mg CaO/gm of anhydrous active substance measured at 22° C. according to the Calcium Binding Power Test Method and at least partial acid solubility in the pH range between 2.5 and 5 and being added to an aqueous liquor having a pH of from about 2.5 to 3.5.

15. The process of claim 14 wherein y is a number of from 1.3 to 20.

16. The process of claim 14 wherein the aluminosilicate has at least partial acid solubility in the pH range of from 3.5 to 4.5.

17. The process of claim 14 wherein the aluminosilicate has a calcium-complexing capacity of from 0 to <20 mg CaO/gm of anhydrous active substance.

18. The process of claim 14 wherein the aluminosilicate has at least partial solubility in a solution of 2.5 ml concentrated formic acid in 100 ml water.

19. The process of claim 18 wherein said partial solubility is such that said aluminosilicate gives a pH value of at least 2.5 in a suspension on slow titration under stirring in the course of from 8 to 30 minutes at a temperature of 22° C. of a suspension of 2 gm of said aluminosilicate, based on the anhydrous active substance, in 100 ml of distilled water by 2 ml of concentrated formic acid.

20. The process of claim 19 wherein the pH value is from 2.5 to 5.5 after the addition of 2 ml of formic acid.

21. The process of claim 19 wherein the pH value is from 3.5 to 4.5.

22. The process of claim 1 wherein from about 4 to 6 gm/l of the water-insoluble aluminosilicate are added.

23. The process of claim 14 wherein from about 4 to 6 gm/l of the water-insoluble aluminosilicate are employed.

* * * * *